US012397336B2

(12) United States Patent
Kroening et al.

(10) Patent No.: US 12,397,336 B2
(45) Date of Patent: Aug. 26, 2025

(54) HAND-HELD CONDUIT BENDING TOOL WITH MULTIPLE BENDING CHANNELS

(71) Applicant: Greenlee Tools, Inc., Rockford, IL (US)

(72) Inventors: John Wayne Kroening, Machesney Park, IL (US); Sachin Shashikant Dakare, Pune (IN); Andrew Francis Troy, Chicago, IL (US); Katey Earley, Crystal Lake, IL (US); Rahul Maruti Nanche, Kolhapur (IN); Jae Kwang Lee, Rockford, IL (US); John Hagan, Roscoe, IL (US)

(73) Assignee: EMERSON PROFESSIONAL TOOLS, LLC, Elyria, OH (US)

( * ) Notice: Subject to any disclaimer, the term of this patent is extended or adjusted under 35 U.S.C. 154(b) by 25 days.

(21) Appl. No.: 17/455,953

(22) Filed: Nov. 22, 2021

(65) Prior Publication Data

US 2023/0115014 A1 Apr. 13, 2023

(30) Foreign Application Priority Data

Oct. 11, 2021 (IN) ..... 202121046158

(51) Int. Cl.
*B21D 7/06* (2006.01)
*B21D 7/02* (2006.01)

(52) U.S. Cl.
CPC ..... *B21D 7/063* (2013.01); *B21D 7/021* (2013.01)

(58) Field of Classification Search
CPC ..... B21D 7/063; B21D 7/14; B21D 7/085; B21D 7/08; B21D 7/02; B21D 7/021; B21D 7/024; B21D 7/022; B21D 7/06; B21D 11/02
USPC ..... 72/459
See application file for complete search history.

(56) References Cited

U.S. PATENT DOCUMENTS 1,650,955 A * 11/1927 Miller ..... B21D 7/063 72/157
1,859,406 A * 5/1932 Meighan ..... B21D 7/063 72/459
2,232,819 A * 2/1941 Abramson ..... B21D 7/063 72/217
2,804,791 A * 9/1957 Wheeler ..... B21D 7/063 72/459
2,817,986 A 12/1957 Benfield
2,906,149 A 9/1959 Benfield
(Continued)

OTHER PUBLICATIONS

Klein Tools Catalog #151, pp. 133-134 (pp. 134-135 of document itself) (Year: 2008).*

(Continued)

*Primary Examiner* — Edward T Tolan
(74) *Attorney, Agent, or Firm* — Klintworth & Rozenblat LLP

(57) ABSTRACT

A hand-held conduit bending tool includes an elongated handle and a bender head disposed on the handle. The bender head comprising a body portion having at least one curved channel therein. In an embodiment, the channel is elliptical in cross-section. A handle mount is at a rear end of the body portion and rearward of the hook portion and a foot pedal is formed. In some embodiments, two channels are provided to accommodate two differently sized conduits. Markings are provided to enable use of the tool in a head-down position and in a head-up position.

14 Claims, 13 Drawing Sheets

(56) References Cited

U.S. PATENT DOCUMENTS

| | | | | |
|---|---|---|---|---|
| 2,932,225 | A | 4/1960 | Gardner | |
| 4,009,602 | A | 3/1977 | Linquist | |
| 4,052,881 | A | 10/1977 | Mount | |
| 4,269,056 | A * | 5/1981 | Kozinski | B21D 7/063 72/459 |
| 4,442,695 | A | 4/1984 | Gardner | |
| 4,587,832 | A * | 5/1986 | Illguth | B21D 7/063 72/17.3 |
| 4,622,837 | A | 11/1986 | Bergman | |
| D326,395 | S | 5/1992 | Aulgur | |
| 5,669,258 | A | 9/1997 | Luebke | |
| 5,727,419 | A | 3/1998 | Walsten | |
| D410,658 | S | 6/1999 | Walsten | |
| 5,927,141 | A | 7/1999 | Walsten | |
| 7,328,601 | B1 | 2/2008 | King | |
| 11,305,324 | B2 | 4/2022 | Barton | |
| D959,221 | S | 8/2022 | Busenitz | |
| 11,440,070 | B1 | 9/2022 | Bergeson | |
| 11,498,106 | B2 | 11/2022 | Williams et al. | |
| 2003/0233859 | A1 | 12/2003 | Luebke et al. | |
| 2004/0182129 | A1 | 9/2004 | Hopwood | |
| 2017/0095849 | A1 | 4/2017 | Nobles | |
| 2017/0274437 | A1 | 9/2017 | Klinger | |
| 2018/0272404 | A1 | 9/2018 | Williams et al. | |
| 2022/0126348 | A1 | 4/2022 | Fildes et al. | |
| 2023/0115014 | A1 | 4/2023 | Kroening et al. | |
| 2023/0241661 | A1 | 8/2023 | Harvey et al. | |

OTHER PUBLICATIONS

Greenlee 840A Site-Rite Aluminum Hand Bender Head for ½" EMT available at https://www.greenleestore.com/products/greenlee-840a-site-rite-aluminum-hand-bender-head-for-1-2-emt.

Greenlee 841AH Site-Rite Aluminum Hand Bender with Handle for ¾" EMT, ½" Rigid/IMC available at https://www.greenleestore.com/products/greenlee-841ah-site-rite-aluminum-hand-bender-with-handle-for-3-4-emt-1-2-rigid-imc?_pos=1&_sid=0d9cebcde&_ss=r.

Greenlee 841A Site-Rite Aluminum Hand Bender Head for ¾" EMT, ½" Rigid/IMC available at https://www.greenleestore.com/products/greenlee-841a-site-rite-aluminum-hand-bender-head-for-3-4-emt-1-2-rigid-imc?_pos=2&_sid=0d9cebcde&_ss=r.

Klein-Benfield® Short-Radius Combination Benders available at http://www.e-rackonline.com/store/bending-and-flaring-tools/klein-benfieldreg-short-radius-combination-benders/#gsc.tab=0.

Klein-Benfield® Short-Radius Combination Bender images.

* cited by examiner

HAND-HELD CONDUIT BENDING TOOL WITH MULTIPLE BENDING CHANNELS

FIELD OF THE DISCLOSURE

The present disclosure relates to a hand-held conduit bending tool having multiple channels for manually bending electrical conduit.

BACKGROUND

Hand-held conduit bending tools for bending electrical conduits are known, and usually include a one-piece body that has an elongated curved bender head at its bottom, a hook at its front end, and an upwardly projecting handle receptacle in which a shaft-like handle is removably receivable. A foot pedal is provided at the rear of the bender head, and the user can step onto the foot pedal. The bender head has a curved channel therein in which the conduit is seated and is bent during a bending operation. The hook is engaged under a length of conduit to be bent, which is held against a floor or other supporting surface, and a bending force is exerted upon the handle and the foot pedal, transmitted to the conduit by means of the hook, and curves the conduit around the bender head. Examples of such conduit bending tools are provided in U.S. Pat. No. 4,622,837 and in United States Publication Nos. 2003/0233859, 2004/0182129, and 2017/0274437.

SUMMARY

A hand-held conduit bending tool in accordance with example embodiments includes an elongated handle having a free end and a connected end; and a bender head disposed on the connected end of the handle, the bender head comprising a body portion having a front end, an opposite rear end, upper and lower surfaces extending from the front end to the rear end, and opposite first and second side surfaces extending from the front end to the rear end, wherein the body portion has a curved channel formed therein extending upward from the lower surface, the channel including opposite first and second side walls Which are separated by a base wall, wherein a longitudinal axis extends from a front end of the channel to a rear end of the channel, the first side wall terminating in a first lower wall surface, the second side wall terminating in a second lower wall surface, and wherein the channel is elliptical in cross-section along all cross-sections thereof taken transverse to the longitudinal axis, and wherein a distance taken from the base wall to each lower wall surface is less than a diameter of a conduit having a circular cross-section which is configured to be positioned within the channel.

A hand-held conduit bending tool in accordance with example embodiments includes a bender head comprising a body portion having a front end, an opposite rear end, a lower surface extending from the front end to the rear end, and an opposite upper surface extending from the front end to the rear end, and a hook portion extending from the front end of the body portion, the body portion having a curved channel formed therein extending from the lower surface and from the front end to the rear end, the curved channel being configured to receive a conduit, and a handle mount provided by the body portion at the front end of the body portion and rearward of the hook portion, wherein a portion of the upper surface rearward of the handle mount forms a foot pedal; and an elongated handle having a free end and a connected end, the connected end of the handle being in the handle mount.

A hand-held conduit bending tool in accordance with example embodiments includes a bender head comprising a body portion having a front end, an opposite rear end, upper and lower surfaces extending from the front end to the rear end, and opposite first and second side surfaces extending from the front end to the rear end, and a hook portion extending from the front end of the body portion, the body portion having a first curved channel formed therein extending from the lower surface and from the front end to the rear end, the first channel being proximate to the first side surface and configured to receive a first conduit, a second curved channel formed in the body portion and extending from the lower surface and from the front end to the rear end, the second channel being proximate to the second side surface and being differently sized than the first channel so as to accept a differently sized diameter conduit therein, wherein first markings are provided on the lower surface proximate to the first channel, second markings are provided on the first side surface, third markings are provided on the lower surface proximate to the second channel, and fourth markings are provided on the second side surface, wherein the first and second markings indicate bend angles for the first channel, and the third and fourth markings indicate bend angles for the second channel; and an elongated handle extending from the bender head.

This Summary is provided merely for purposes of summarizing some example embodiments so as to provide a basic understanding of some aspects of the disclosure. Accordingly, it will be appreciated that the above described example embodiments are merely examples and should not be construed to narrow the scope or spirit of the disclosure in any way. Other embodiments, aspects, and advantages of various disclosed embodiments will become apparent from the following detailed description taken in conjunction with the accompanying drawings which illustrate, by way of example, the principles of the described embodiments.

BRIEF DESCRIPTION OF THE DRAWINGS

The organization and manner of the structure and operation of the disclosed embodiments, together with further objects and advantages thereof, may best be understood by reference to the following description, taken in connection with the accompanying drawings, which are not necessarily drawn to scale, wherein like reference numerals identify like elements in which.

DETAILED DESCRIPTION

Figure 1:
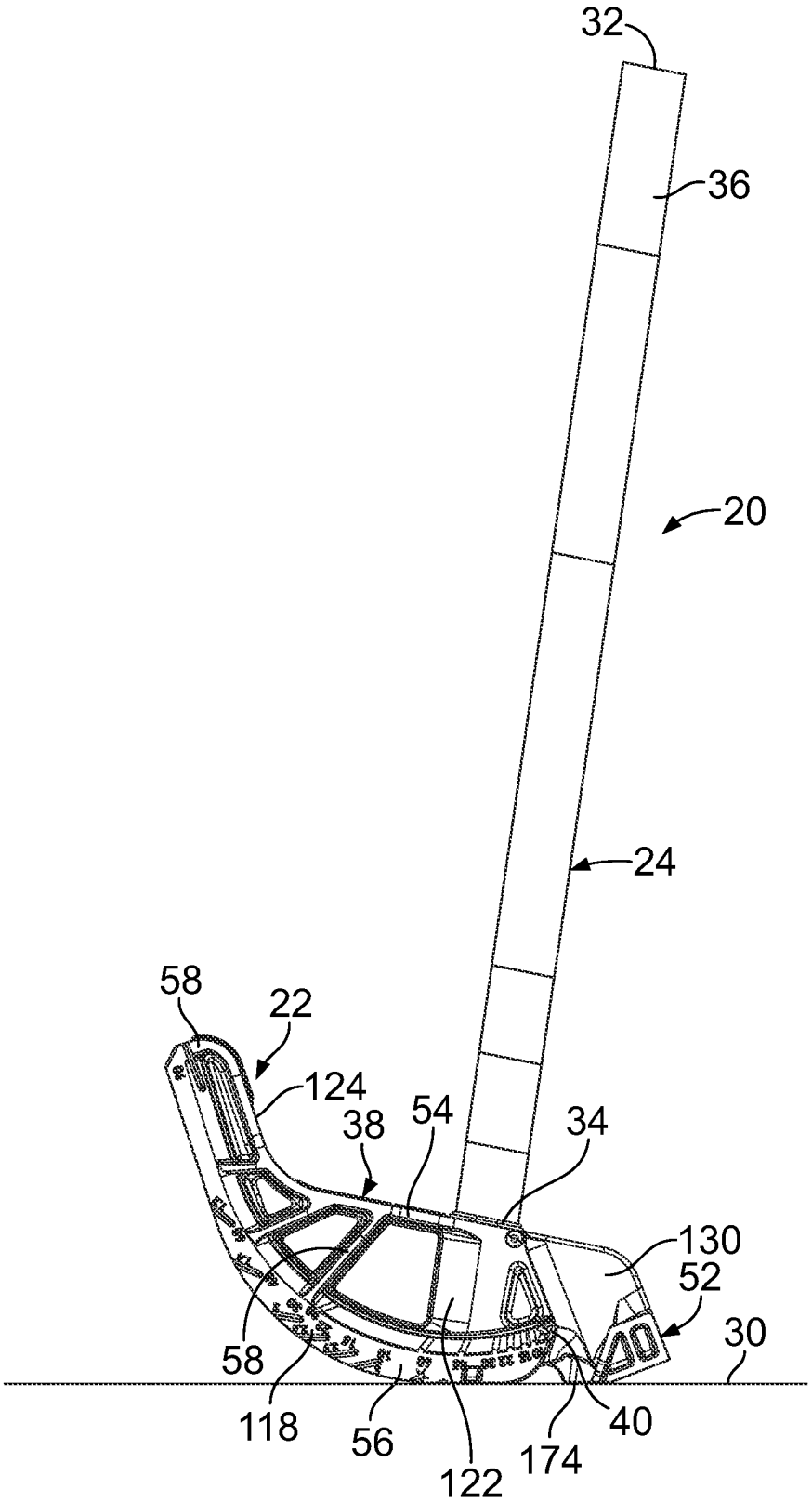
FIG. 1 depicts a side elevation view of a hand-held conduit bending tool in accordance with an embodiment of the present disclosure.
Figure 2:
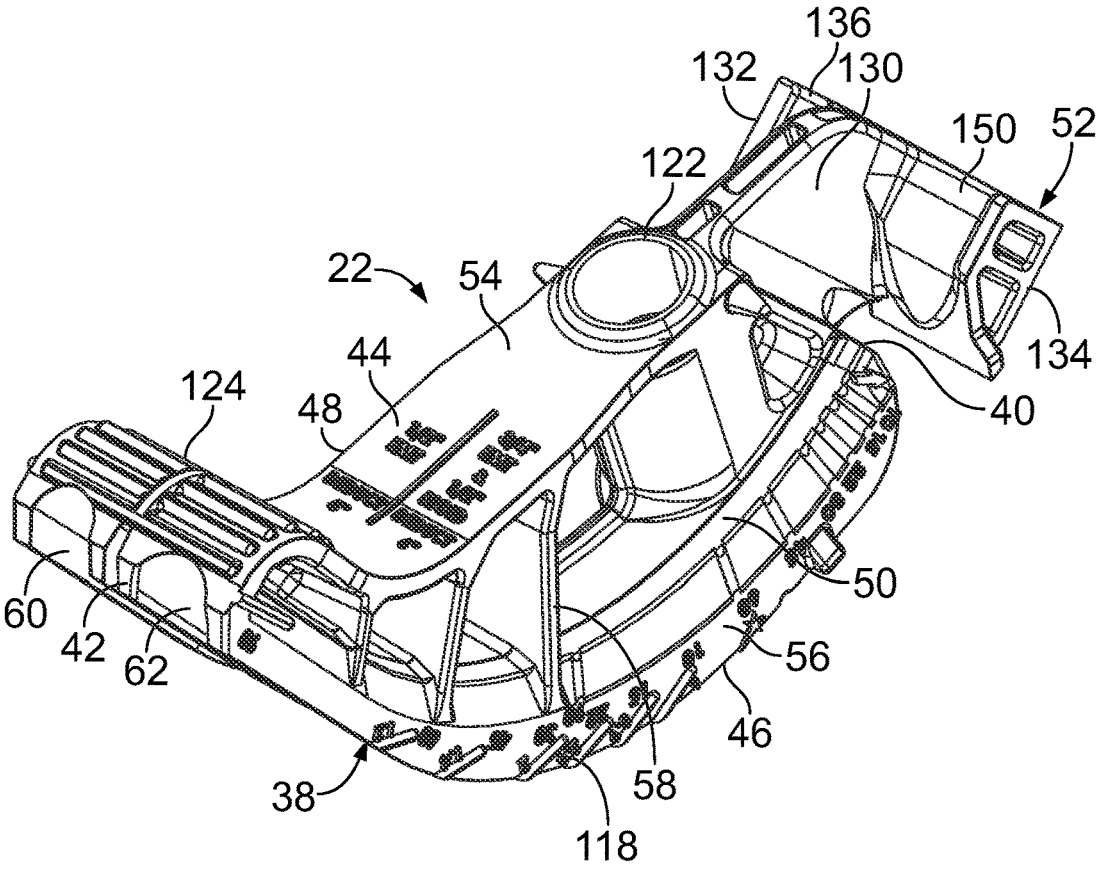
FIGS. 2 and 3 depict perspective views of a bending head of the hand-held conduit bending tool.
Figure 3:
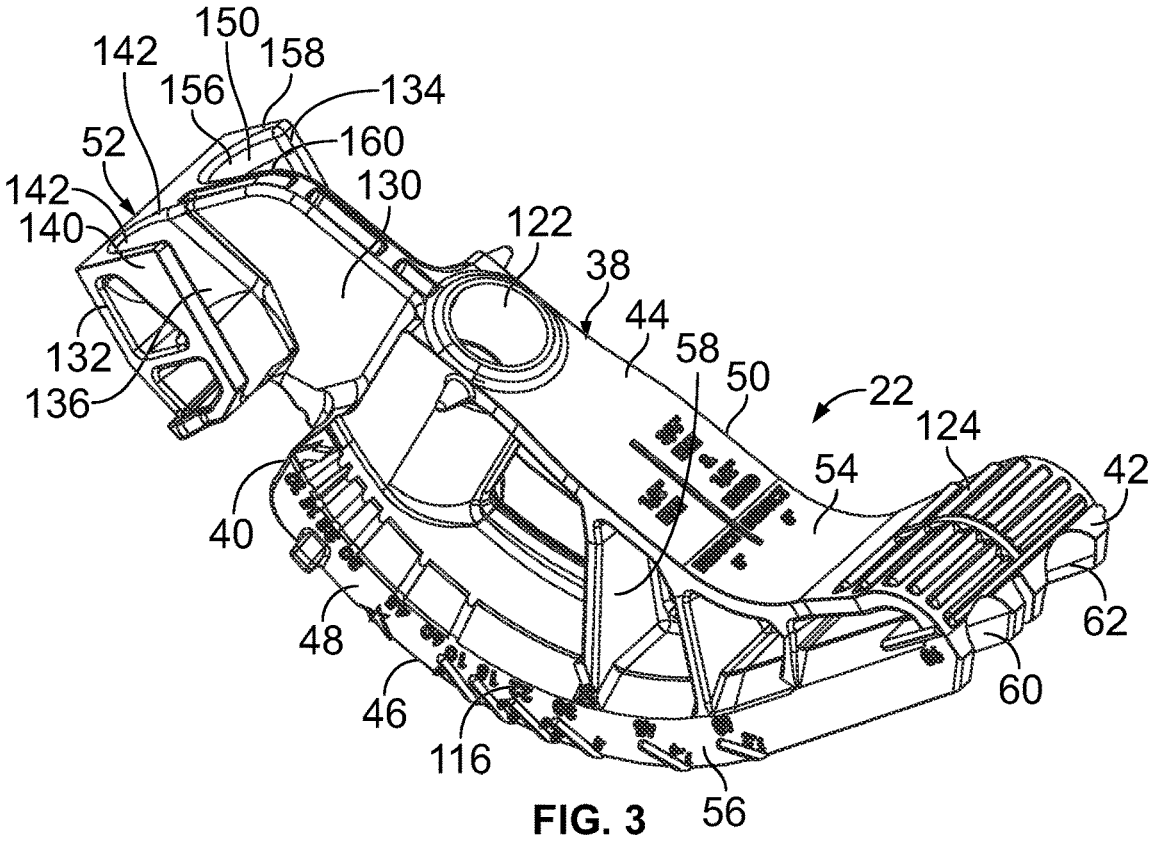
Figure 4:
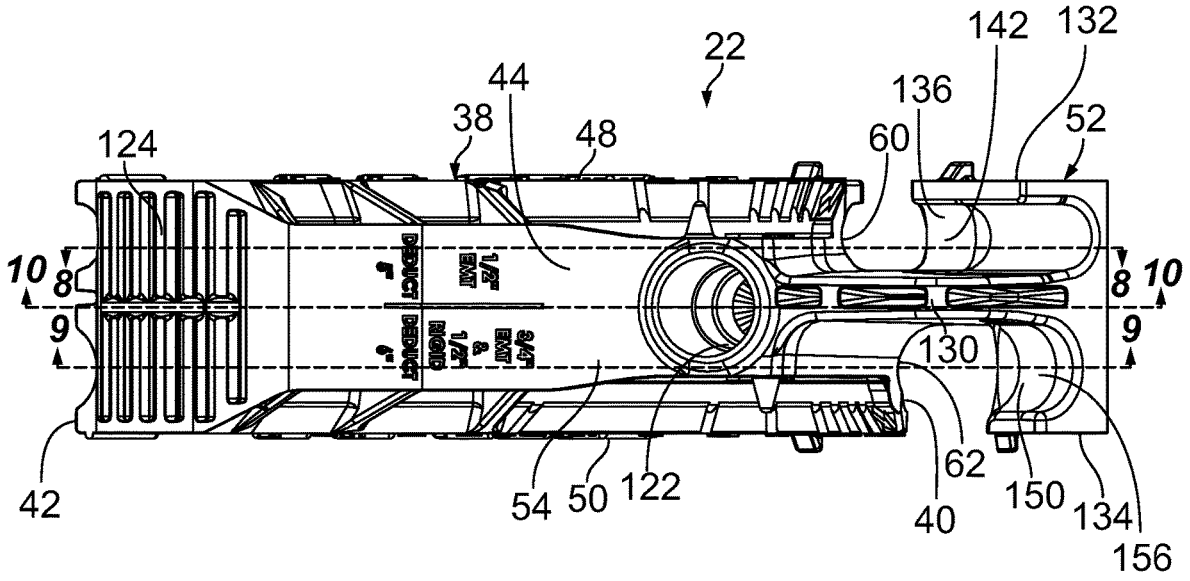
FIG. 4 depicts a top plan view of the bending head.
Figure 5:
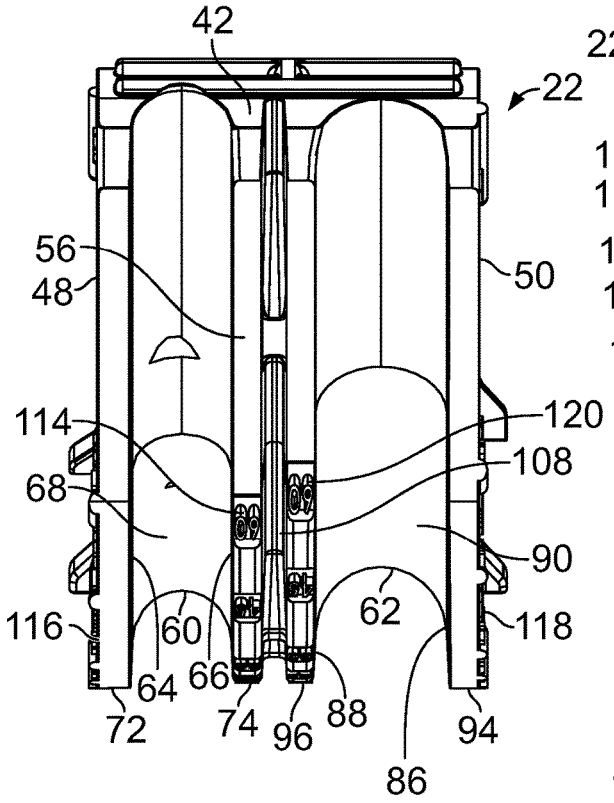
FIG. 5 depicts a rear elevation view of the bending head.
Figure 6:
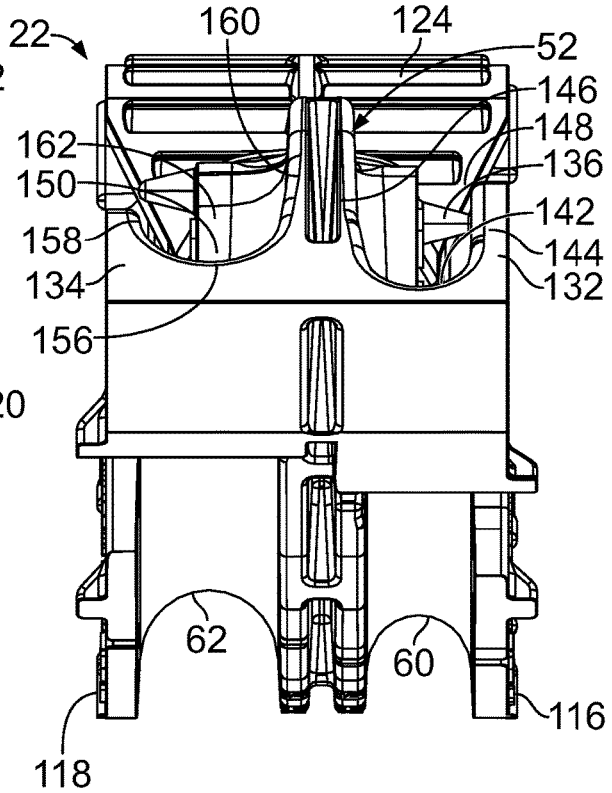
FIG. 6 depicts a rear elevation view of the bending head.

While the disclosure may be susceptible to embodiment in different forms, there is shown in the drawings, and herein will be described in detail, a specific embodiment with the understanding that the present disclosure is to be considered an exemplification of the principles of the disclosure, and is not intended to limit the disclosure to that as illustrated and described herein. Therefore, unless otherwise noted, features disclosed herein may be combined together to form additional combinations that were not otherwise shown for purposes of brevity. It will be further appreciated that in some embodiments, one or more elements illustrated by way of example in a drawing(s) may be eliminated and/or substituted with alternative elements within the scope of the disclosure.

A hand-held conduit bending tool 20 includes a bender head 22 and an elongated handle 24. The conduit bending tool 20 is used to bend a straight portion of the conduit 26, 28 having a circular cross-section into a bent shape when pressure is applied to the by a user. The handle 24 has a free end 32 and a connected end 34 and the bender head 22 is disposed on the connected end 34 of the handle 24. The bender head 22 may be constructed from cast iron, aluminum, polymers with various fillers to promote strength, or other suitable material. The handle 24 may be constructed from plastic, or metal, such as tubular steel, or other suitable material. The handle 24 may have a grip 36, such as for example a rubber molding, or knurling provided on the free end 32 to assist in the user grip on the handle 24. For convenience in explanation only, terms such as upper, lower are used, but do not indicate that these directions are required during use of the conduit bending tool 20.

The bender head 22 includes a body portion 38 having a front end 40, an opposite rear end 42, upper and lower surfaces 44, 46 extending between the front and rear ends 40, 42, first and second side surfaces 48, 50 extending between the front and rear ends 40, 42 and the upper and lower surfaces 44, 46, and a hook portion 52 extending from the front end 40 of the body portion 38. The upper surface 44 may be formed of an upper curved bar 54, and the lower surface 46 may be formed of a lower curved bar 56, which are connected together by a plurality of struts 58 which define windows. Alternatively, the body portion 38 may be a solid part such that the windows are eliminated.

The body portion 38 has first and second downwardly facing channels 60, 62 which extend upwardly from the lower surface 46. Each channel 60, 62 extends from the front end 40 to the rear end 42 of the body portion 38, and each has an open lower end. In some embodiments and as shown, the channels 60, 62 have different profiles which allow for bending of two different sizes of conduit 26, 28 (one conduit has a first diameter, and the second conduit has a second diameter) which reduces the overall cost for the user, since the user can purchase a single conduit bending tool 20, instead of two separate conduit bending tools. In some embodiments, the channels 60, 62 have the same profile which allow for bending of two conduits having the same diameter at the same time.

The first channel 60 includes opposite first and second side walls 64, 66 which are connected by a base wall 68. A longitudinal centerline 70, see FIG. 8, extends from the front end of the first channel 60 to the rear end of the first channel 60 through the midpoint of the base wall 68. The first side wall 64 terminates in a first lower wall surface 72, and the second side wall 66 terminates in a second lower wall surface 74. When the wall surfaces 72, 74 are viewed in side elevation, each wall surface 72, 74 has a front portion 76 which extends from the front end 40 and at a constant radius, and a tail portion 78 extending tangentially from the respective front portion 76 to the rear end 42. The first channel 60 is elliptical in cross-section, see FIG. 7, along all points thereof taken transverse to the longitudinal centerline 70, and the elliptical shape is constant. A distance 80, which may be equivalent to the semi-major axis of the ellipse, taken from the midpoint of the base wall 68 to each wall surface 72, 74 is less than a diameter of the conduit 26 which is configured to be positioned within the first channel 60. When the first channel 60 is viewed in cross-section along the longitudinal centerline 70, see FIG. 8, the first channel 60 mirrors the shape of the portions 76, 78 and has a front portion 82 which extends from the front end 40 and at a constant radius, and a tail portion 84 extending tangentially from the front portion 82 to the rear end 42.

Figure 9:
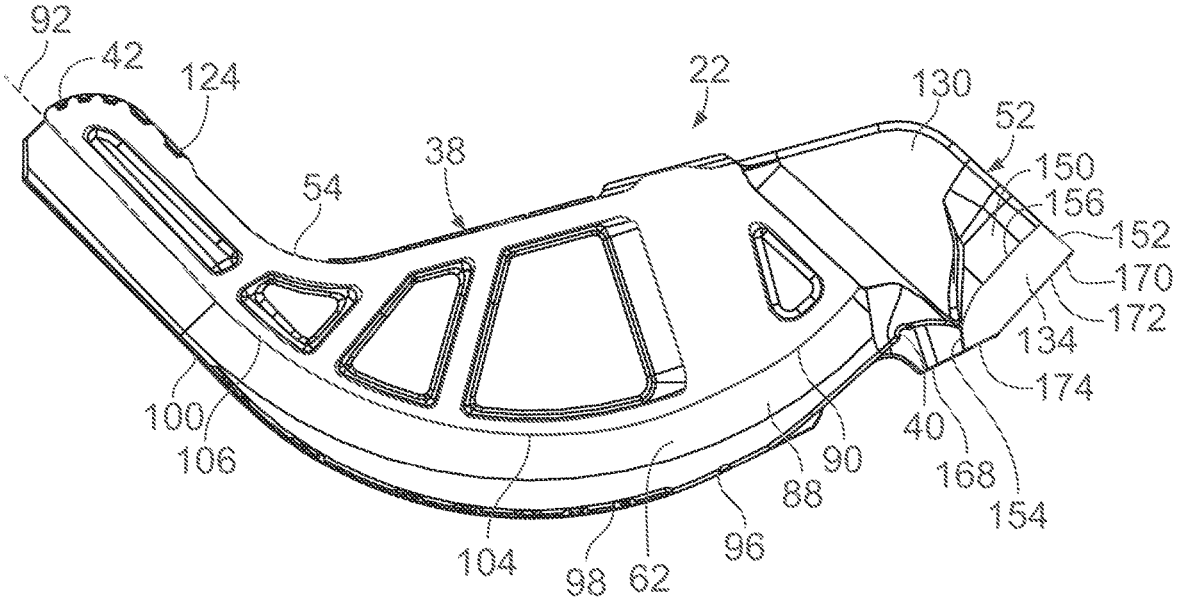
FIG. 9 depicts a cross-sectional view of the bending head along line 9-9 of FIG. 4.
Figure 11:
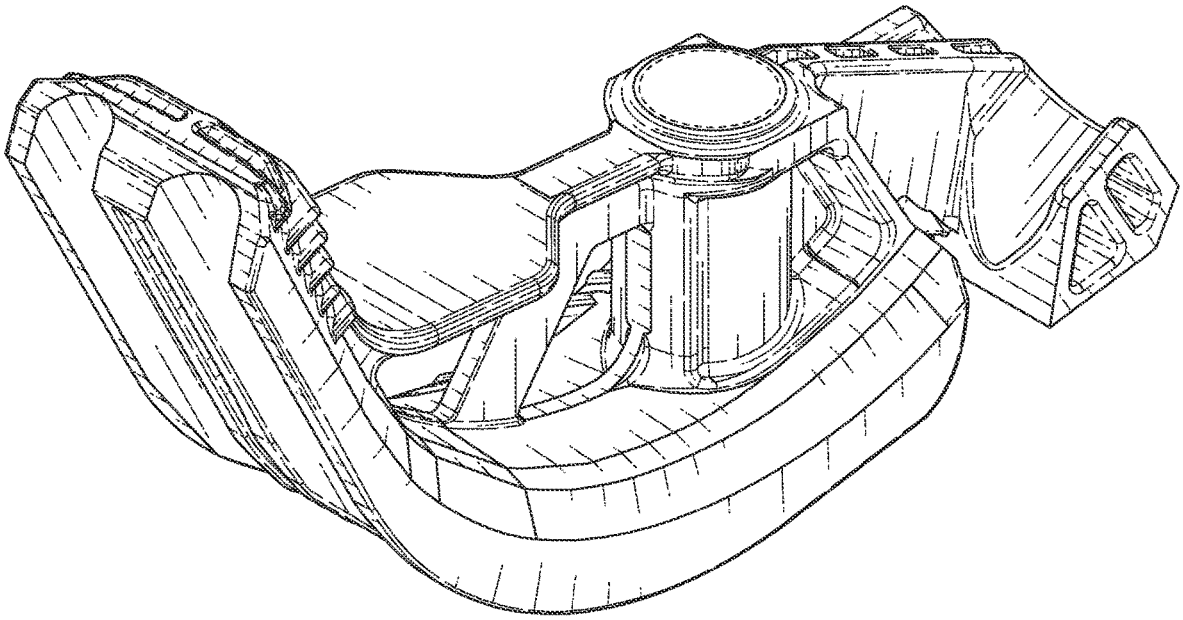
FIG. 11 depicts a top perspective view of an embodiment of a design of the bending head.
Figure 12:
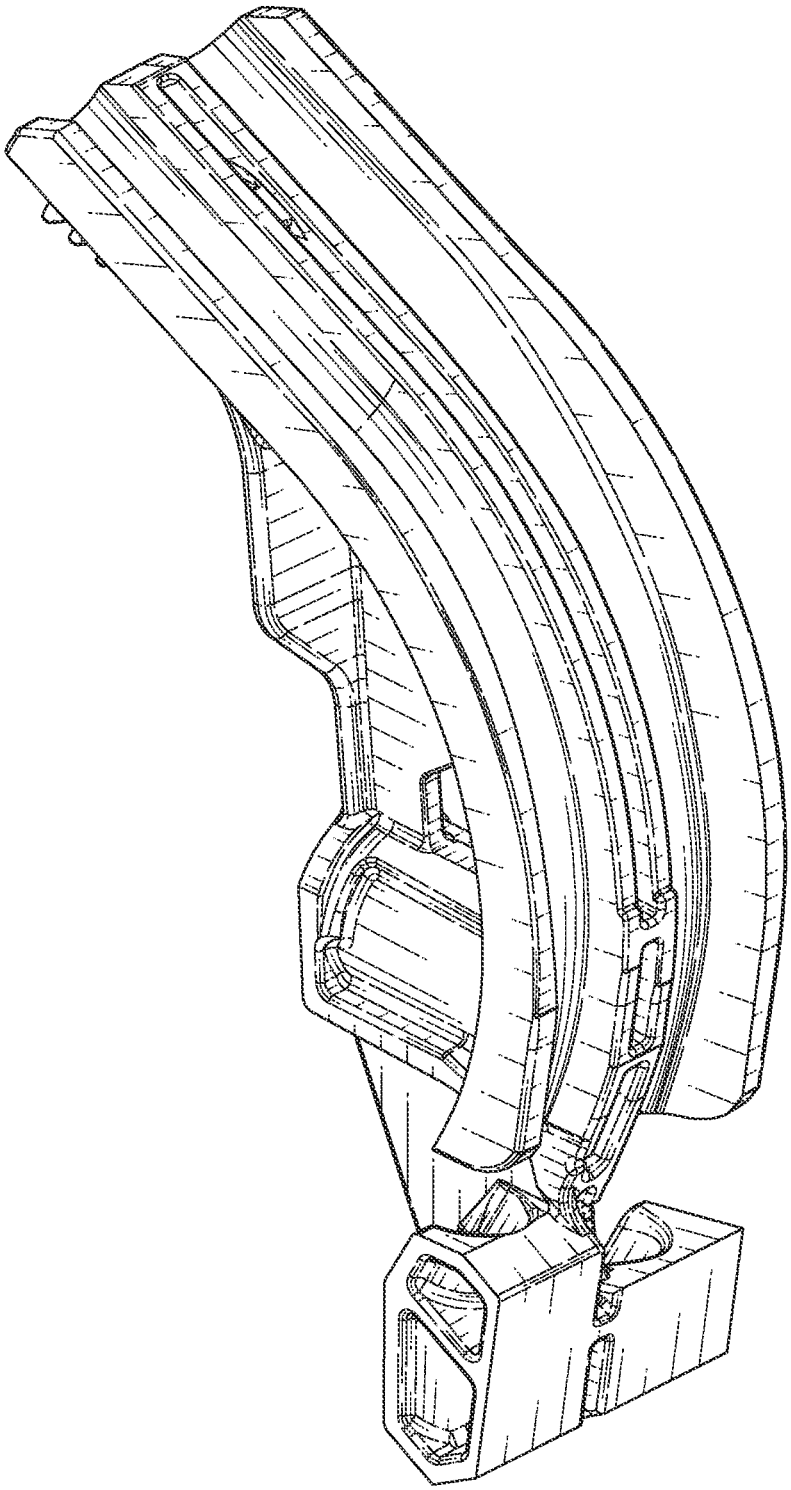
FIG. 12 depicts a bottom perspective view of the embodiment of the bending head of FIG. 11.
Figure 13:
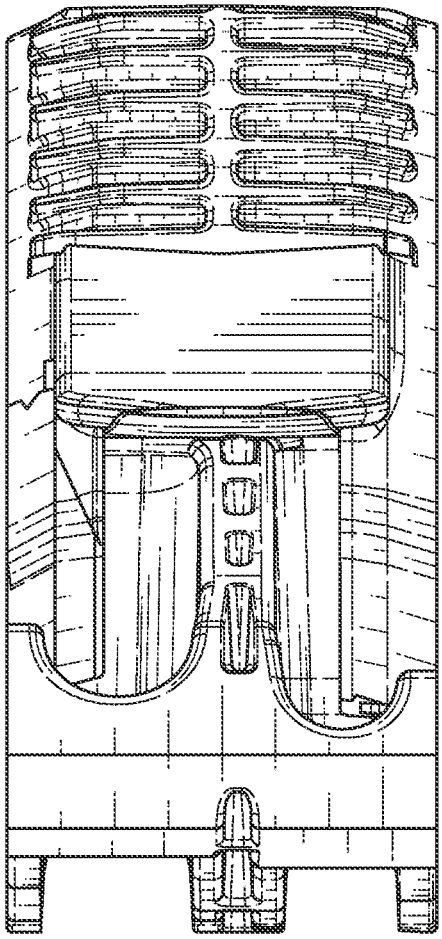
FIG. 13 depicts a front elevation view of the embodiment of the bending head of FIG. 11.
Figure 14:
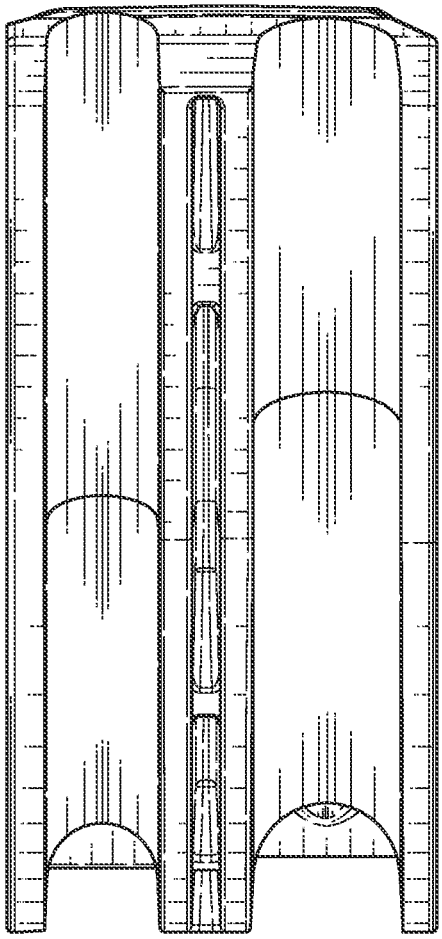
FIG. 14 depicts a rear elevation view of the embodiment of the bending head of FIG. 11.
Figure 15:
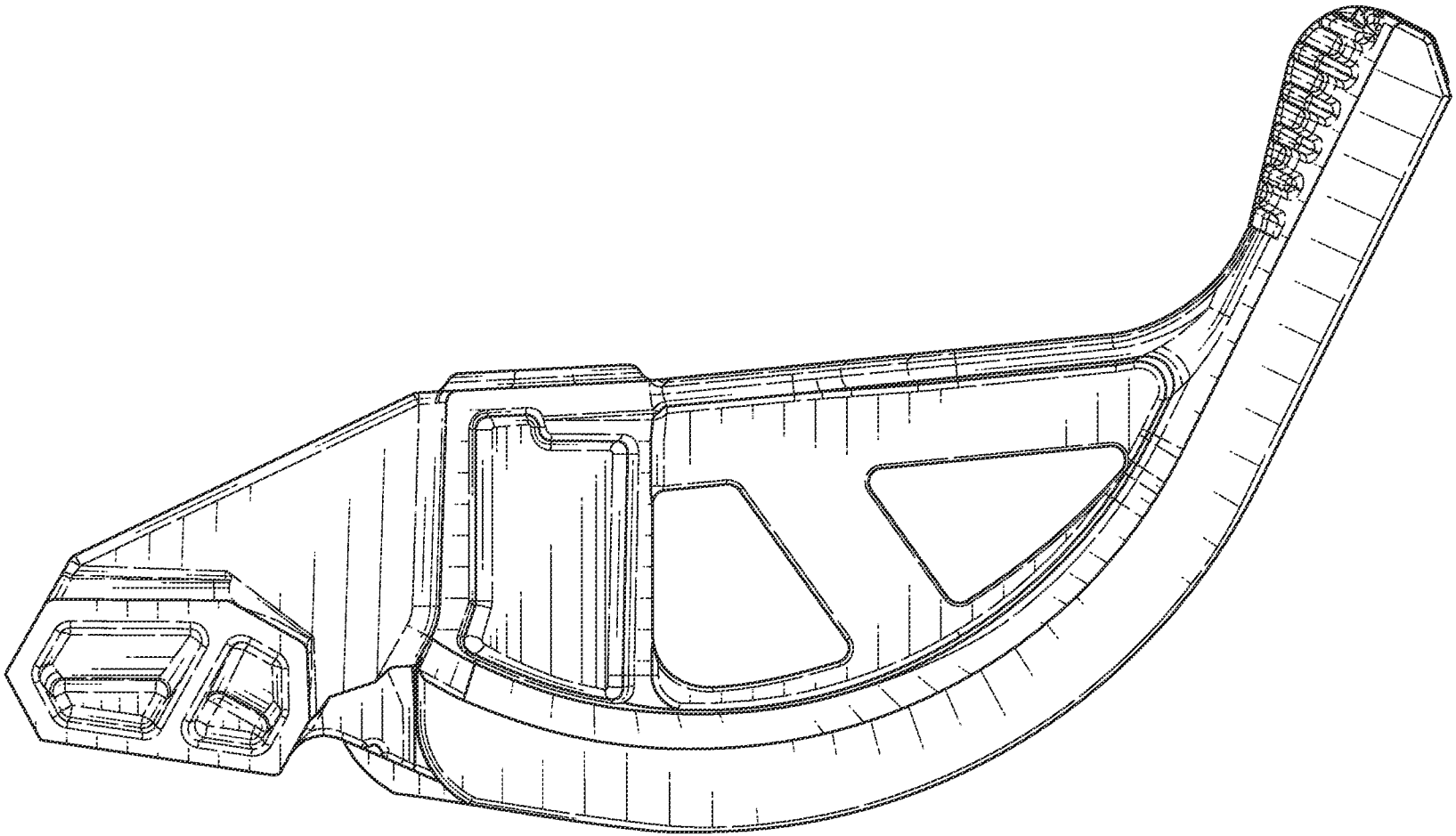
FIG. 15 depicts a left side elevation view of the embodiment of the bending head of FIG. 11.
Figure 16:
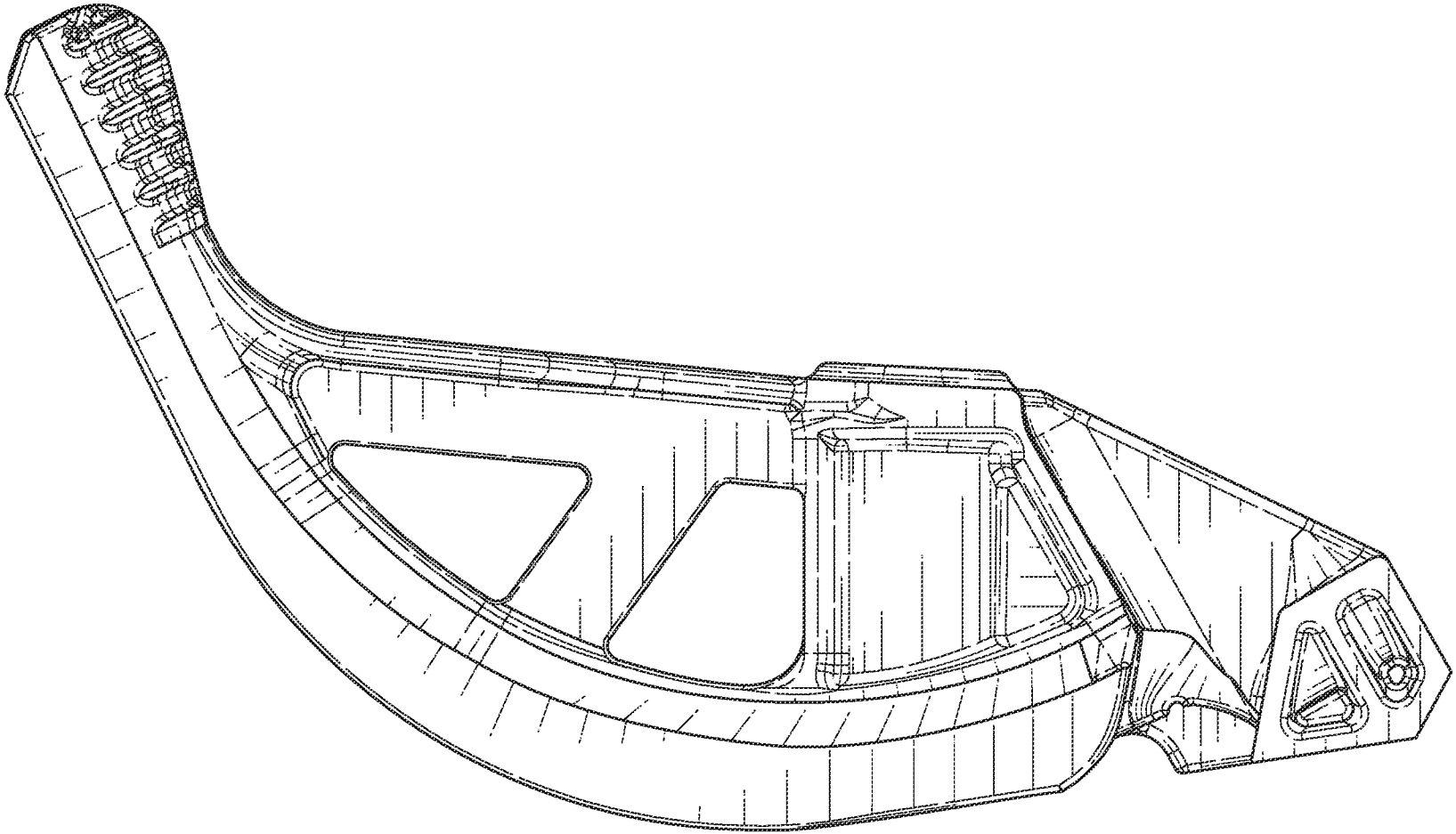
FIG. 16 depicts a right side elevation view of the embodiment of the bending head of FIG. 11.
Figure 17:
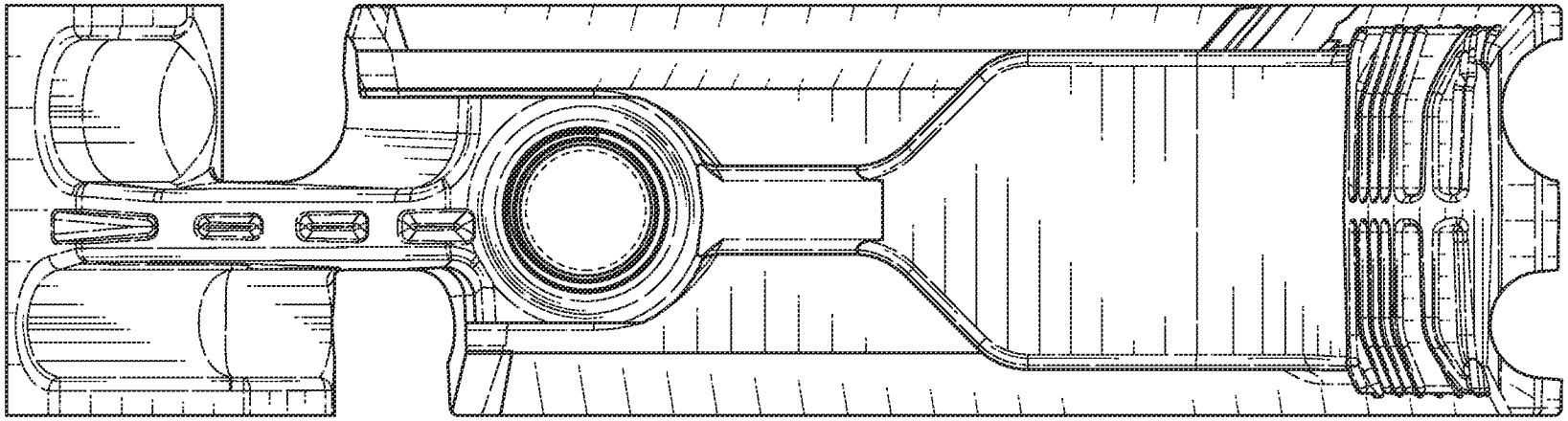
FIG. 17 depicts a top plan view of the embodiment of the bending head of FIG. 11.
Figure 18:
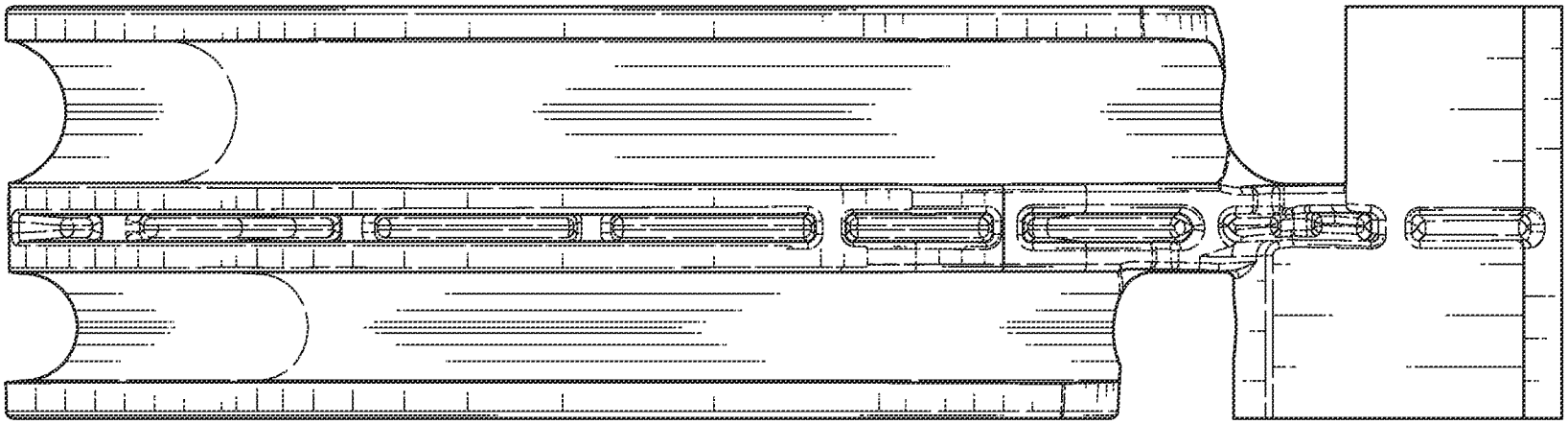
FIG. 18 depicts a bottom plan view of the embodiment of the bending head of FIG. 11.

The second channel 62 includes opposite first and second side walk 86, 88 which are connected by a base wall 90. A longitudinal centerline 92, see FIG. 9, extends from the front end of the second channel 62 to the rear end of the second channel 62 through the midpoint of the base wall 90. The longitudinal centerline 92 is parallel to the longitudinal centerline 70, and the channels 60, 62 are side-by-side. The first side wall 86 terminates in a first lower wall surface 94, and the second side wall 88 terminates in a second lower wall surface 96. When the wall surfaces 94, 96 are viewed in side elevation, each wall surface 94, 96 has a front portion 98 which extends from the front end 40 and at a constant radius, and a tail portion 100 extending tangentially from the respective front portion 98 to the rear end 42. The second channel 62 is elliptical in cross-section, see FIG. 7, along all points thereof taken transverse to the longitudinal centerline 92, and the elliptical shape is constant. A distance 102, which may be equivalent to the semi-major axis, taken from the midpoint of the base wall 90 to each wall surface 94, 96 is less than a diameter of the conduit 28 which is configured to be positioned within the second channel 62. As shown, distance 102 is greater than distance 80. When the second channel 62 is viewed in cross-section along the longitudinal centerline 92, see FIG. 9, the second channel 62 minors the shape of the portions 98, 100 and has a front portion 104 which extends from the front end 40 and at a constant radius, and a tail portion 106 extending tangentially from the front portion 104 to the rear end 42. The minor diameter of the ellipse that forms the second channel 62 is greater than the minor diameter of the ellipse that forms the first channel 60. In the embodiment shown, the first channel 60 is sized to receive a first size of conduit 26 therein, and the second channel 62 is sized to receive a second size of conduit 28 therein which is differently sized than the size of the first conduit 26. For example, the first channel 60 is sized to receive a ½" conduit, and the second channel 62 is sized to receive a ¾" conduit. As another example, the first channel 60 is sized to receive a 1" conduit, and the second channel 62 is sized to receive a ¾" conduit. These examples are not intended to be limiting.

End wall surfaces 72, 94 have the same profile and align with each other in the direction transverse to the longitudinal centerlines 70, 92. When the bender head 22 is placed against a surface 30 in a head down position, the bender head 22 sits level, and such that when the bender head 22 is rolled against the surface 30, the entire length of the wall surfaces 72, 94 contact the surface 30. End wall surfaces 74, 96 may also align with end wall surfaces 72, 94 or may be shorter, as shown. Webbing 108 is provided between the walls 66, 88 and between the front end 40 and the rear end 42. The webbing 108 strengthens the channels 60, 62. Alternatively, the walls may be continuous with each other.

Figure 7:
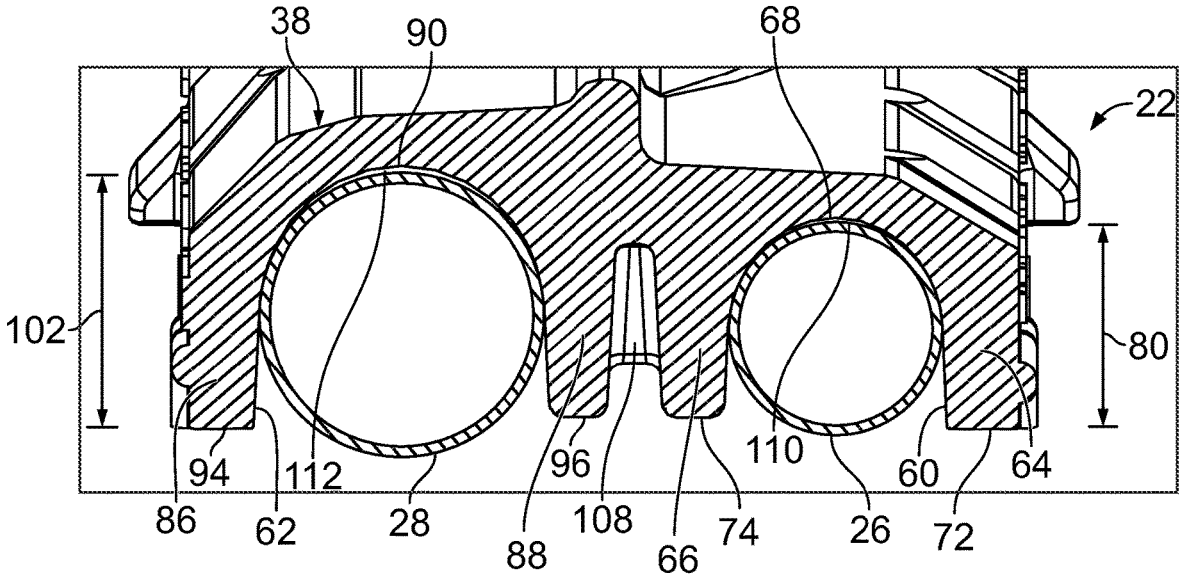
FIG. 7 depicts a partial cross-sectional view of the bending head.

When the conduit 26 is positioned in the first channel 60, the center of the conduit 26 is positioned such that a portion of the conduit 26 is always exposed from the first channel 60, see FIG. 7, and a space 110 is provided between the outer profile of the round conduit 26 and the elliptical first channel 60. When the conduit 26 is being bent, the elliptical shape allows the conduit 26 to nest within the first channel 60 and the side walls 64, 66 provide points of contact with the conduit 26, instead of the conduit 26 bearing against the base 68 of the first channel 60. Since the conduit 26 extends partially out of the first channel 60, the conduit 26 is always in contact with the surface 30 against which is it bearing during a head down bending process. As a result, pressure is always applied to the conduit 26 by the surface 30 during a head down bending process for the entire profile during bending. Likewise, when the conduit 28 is positioned in the second channel 62, the center of the conduit 28 is positioned such that a portion of the conduit 28 is always exposed from the second channel 62, and a space 112 is provided between the outer profile of the round conduit 28 and the elliptical second channel 62. When the conduit 28 is being bent, the elliptical shape allows the conduit 28 to nest within the second channel 62 and the side walls 86, 88 provide points of contact with the conduit 28, instead of the conduit 28 bearing against the base 90 of the second channel 62. Since the conduit 28 extends partially out of the second channel 62, the conduit 28 is always in contact with the surface 30 against which is it bearing during a head down bending process. As a result, pressure is always applied to the conduit 28 by the surface 30 for the entire profile during a head down bending process. These features results in a round cross-sectional shape of the conduit 26, 28 after bending. In addition, when the conduit 26, 28 is being bent, the conduit 26, 28 may move into the space 110, 112. In the prior art channels which provide a circular cross-section, the conduit bears against the base of the channel which can cause the conduit to flatten during bending. In prior art bending tools, the outer profile of the conduit is within the profile of the channel and does not extend outward of the channel. As a result, the conduit sometimes flattens or wrinkles.

As a result of the structure, the bender head 22 combines two channels 60, 62 with a single ground profile. Both channels 60, 62 maintain their respective center die radius (4.18" for ½" EMT conduit for channel 60 and 5.17" for ¾" EMT conduit for channel 62). The wall surfaces 72, 94 provide a common ground profile for uniform pressure on the conduit during bending.

The body portion 38 includes markings 114, 116, 118, 120 thereon which indicate bend angles. The markings 114, 116, 118, 120 may be raised or recessed relative to the body portion 38 and may be cast into the body portion 38. First markings 114 are provided on the second lower wall surface 74 of the second side wall 66 which partially forms the lower surface 46, second markings 116 are provided on the side surface 48 proximate to the lower wall surface 72, third markings 118 are provided on the side surface 50 proximate to the lower wall surface 94, and fourth markings 120 are provided on the second lower wall surface 96 which partially forms the lower surface 46. The first and second markings 114, 116 indicate bend angles for the first channel 60, and the third and fourth markings 118, 120 indicate bend angles for the second channel 62. The markings 114, 116, 118, 120 provide for accurate head-down and head-up bending, as well as for producing stub-ups, offsets, saddles and back-to-back bends. When the conduit bending tool 20 is being used in a head-down position (the conduit 26 and/or 28 bears against the floor during bending), the markings 116, 118 are used by the user to determine the bend angle. When the conduit bending tool 20 is being used in a head-up position (the free end 32 is against the floor and the user's foot is against the grip 36), the markings 114, 120 are used by the user to determine the bend angle (surface 46 is described herein as the lower surface for ease in explanation only and is not a required orientation; when the conduit bending tool 20 is being used in the head-up position, then the surfaces 72, 74, 94, 96 form an upper surface of the conduit bending tool 20). In the embodiment as shown, since the bender head 22 has two different centerline bend radii, the markings 114, 116 are positioned differently to show the appropriate bend angle, and the markings 118, 120 are positioned differently to show the appropriate bend angle. The markings 114, 116, 118, 120 provide easy visibility for the user to determine the appropriate bend angle in the head-down position or in the head-up position. In an embodiment which has channels 60, 62 with the same profile, the markings 114, 116, 118, 120 are not positioned differently.

Figure 10:
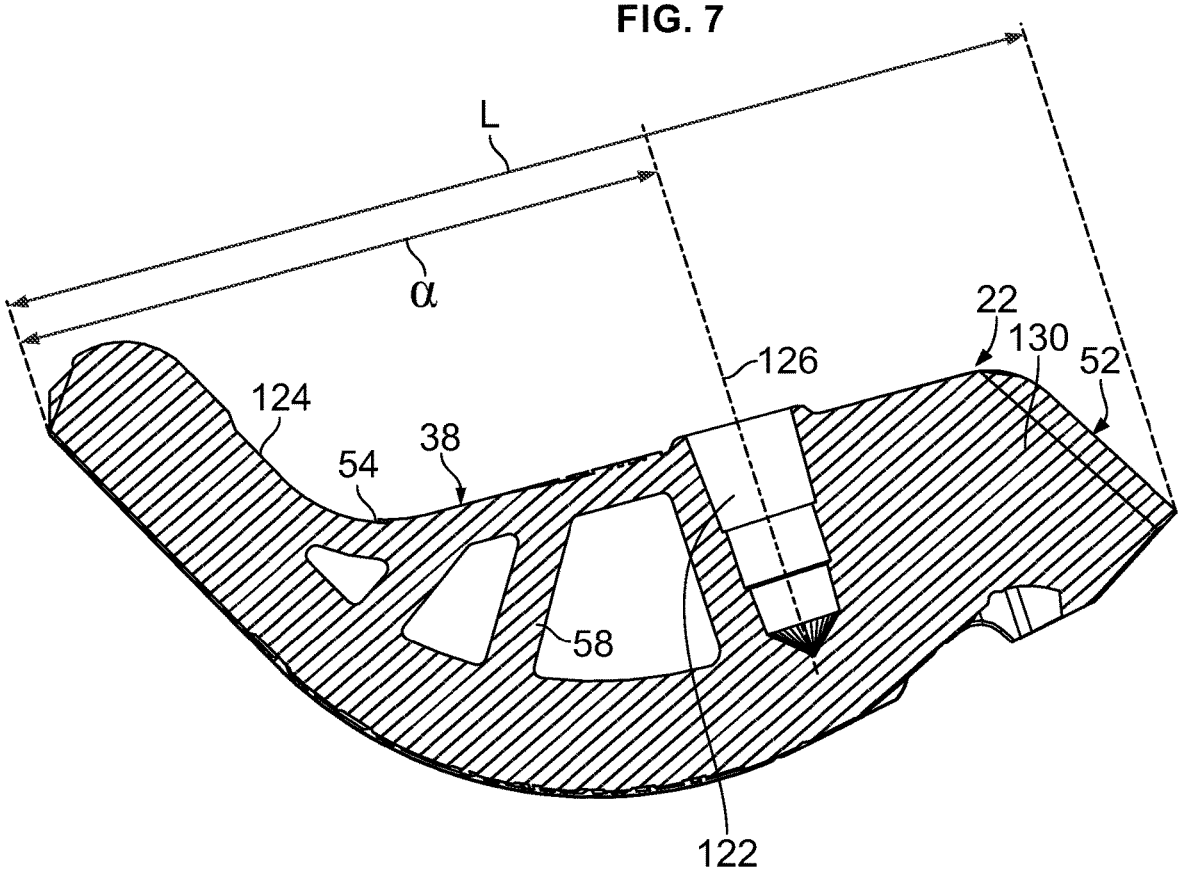
FIG. 10 depicts a cross-sectional view of the bending head along line 10-10 of FIG. 4.
Figure 8:
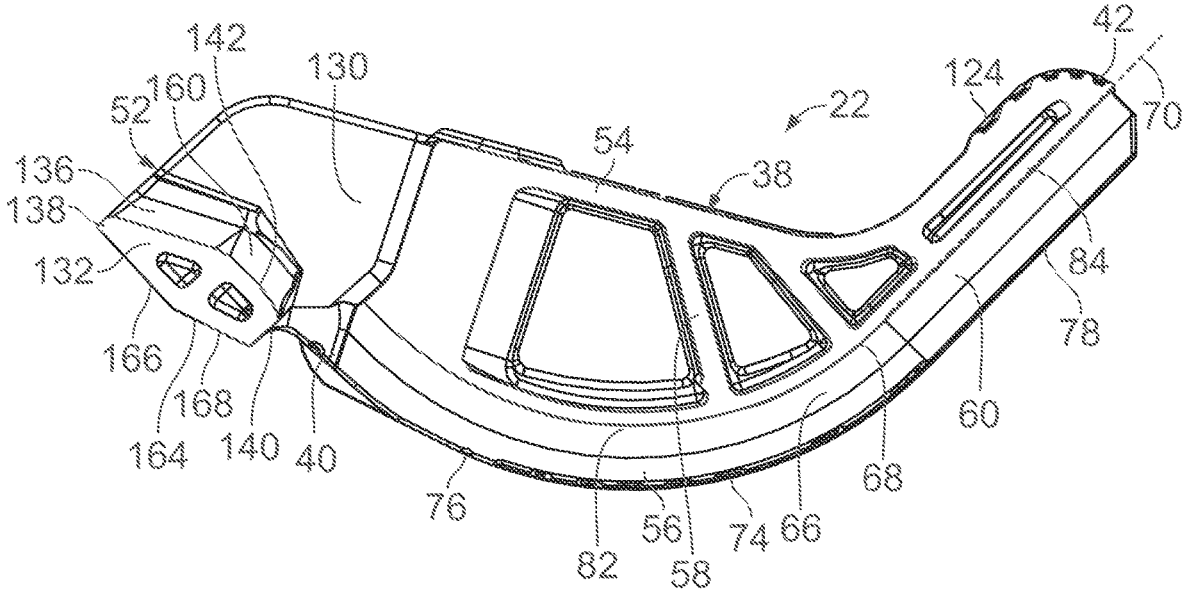
FIG. 8 depicts a cross-sectional view of the bending head along line 8-8 of FIG. 4.

The body portion 38 includes a handle mount 122 which attaches the handle 24 to the body portion 38. In some embodiments, the handle mount 122 is formed by an open ended receptacle extending downward from the upper surface 44 in the body portion 38, and the handle 24 seats within the receptacle. The handle mount 122 may be formed by one of the struts. The handle 24 may be detachable from the bender head 22 or fixedly attached to the bender head 22. While the handle 24 is described as being mounted to the body portion 38, in some embodiments, the handle 24 is integrally formed with the bender head 22 such that the handle mount 122 is integrally formed with the body portion 38 and the handle 24. The handle mount 122 is positioned proximate to the front end 40 of the body portion 38 and rearward of the hook portion 52. The handle mount 122 generally aligns with the front end 40 of the body portion 38. In an embodiment, the handle mount 122 is positioned within the first quarter of the front portions 82, 104 that extends from the front end 40 of the body portion 38. As shown, the handle mount 122 is vertically above the front portions 82, 104 and partially overlaps the channels 60, 62. As a result of this forward positioning of the handle mount 122, an elongated foot pedal 124 is provided between the handle mount 122 and the rear end 42 of the body portion 38. The foot pedal 124 provides a long and wide rest for the user's foot which increases the comfort of the user. A plurality of deep serrations may be formed in the upper surface of the foot pedal 124 for improved gripping by the boot of the user during the application of force by the user onto the foot pedal 124 during the bending operation. Since the handle mount 122 is positioned proximate to the front end 40 of the body portion 38, additional room is provided for the user's boot on the upper surface 44 of the body portion 38 rearward of the handle mount 122 versus prior art bending tools which provide the handle mount 122 at approximately the center of the body portion 38. As a result of the positioning, the length of the body portion 38 is the same as provided in this prior art, but since the handle mount 122 has been moved forward in the present disclosure, additional room is provided for the user's boot without adding material cost which would result from adding an extension for the foot rest. Because the foot pedal 124 is enlarged, this provides for increased toe room to ensure greater control, stability and leverage during operation. The handle mount 122 defines a central axis 126, see FIG. 10, which extends from its open end to its closed lower end. The central axis 126 is vertical when a 30 degree bend has been achieved. The location of the central axis 126 may be located along the length L of the bender head 22 at location a when measured from the rear end 42 and in a plane perpendicular to the central axis 126 as shown in FIG. 8. The central axis 126 may be located along the length L of the bender head at a distance of 58%-75% ($\alpha$) of the length L of the bender head 22 away from the rear end 42. More preferably, the central axis 126 may be located along the length L of the bender head at a distance of 60%-65% ($\alpha$) of the length L of the bender head 22 away from the rear end 42. When the handle 24 is mounted within the handle mount 122, a user can comfortably grasp the grip 36 of the handle 24 during the bending process to apply an appropriate amount of leverage by pulling backward on the handle 24, while comfortably stepping on the foot pedal 124. The lower wall surfaces 72, 94 rest on the surface 30 which provides better stability in the stand alone head-down and handle-up resting position when on the ground.

The hook portion 52 is generally T-shaped, and extends forwardly from the center of the handle mount 122 at the front end 40 of the body portion 38. The handle mount 122 strengthens the hook portion 52. The hook portion 52 has a central spine 130 which extends longitudinally from the front end 40 of the body portion 38, a first hook 132 that extends perpendicular to the central spine 130 and from a first side of the central spine 130, and a second hook 134 that extends perpendicular to the central spine 130 and from a second, opposite side of the central spine 130. The first hook 132 has an open topped, generally U-shaped channel 136 extending downward from an upper surface thereof, and which extends from a front end 138 of the first hook 132 to a rear end 140 of the first hook 132, and which longitudinally aligns with the first channel 60 in the body portion 38. The rear end 140 of the first hook 132 is spaced from the front end 40 of the body portion 38. The channel 136 has a base wall 142, and opposite side walls 144, 146 extending from the base wall 142 to an open upper end 148. A rear portion of the base wall 142 and the lower portions of the side walls 144, 146 form a cylindrical shape extending from the rear end thereof 140. When the conduit 26 is initially inserted into the conduit bending tool 20, the conduit 26 is slid through a portion of the first channel 60 in the body portion 38, through the rear end 140 of the channel 136, and then into or through the channel 136. The conduit 26 is parallel to the central spine 130 when inserted into the channels 60, 136. The conduit 26 rests on the base wall 142 and the cylinder formed by the base wall 142 and the lower portions of the side walls 144, 146 provide a stable starting point for the conduit 26. Likewise, the second hook 134 has an open topped, generally U-shaped channel 150 extending downward from an upper surface thereof, and which extends from a front end 152 of the second hook 134 to a rear end 154 of the second hook 134, and which longitudinally aligns with the second channel 62 in the body portion 38. The rear end 154 of the second hook 134 is spaced from the front end 40 of the body portion 38. The channel 150 has a base wall 156, and opposite side walls 158, 160 extending from the base wall 156 to an open upper end 162. A rear portion of the base wall 156 and the lower portions of the side walls 158, 160 form a cylindrical shape extending from the rear end 154. When the conduit 28 is initially inserted into the conduit bending tool 20, the conduit 28 is slid through a portion of the second channel 62 in the body portion 38, through the rear end 154 of the channel 150, and into the channel 150. The conduit 28 is parallel to the central spine 130 when inserted into the channels 62, 150. The conduit 28 rests on the base wall 156 and the cylinder formed by the base wall 156 and the lower portions of the side walls 158, 160 provide a stable starting point for the conduit 28. The channels 136, 150 may have grooves (not shown) in their upper surfaces to assist in gripping the conduits 26, 28 when placed therein. Since the hooks 132, 134 extend outward from the central spine 130, a smaller moment is provided during bending than when both hooks extend from the same side of a single spine.

The first hook 132 has a bottom surface 164 which includes a front portion 166 that extends from the front end 138 to a rear portion 168 that extends therefrom to the rear end 140. The rear portion 168 is planar and extends tangentially from the front portions 76. The front portion 166 extends at an angle relative to the rear portion 168. The second hook 134 has a bottom surface 170 which includes a front portion 172 that extends from the front end 152 to a rear portion 174 that extends therefrom to the rear end 154. The rear portion 174 is planar and extends tangentially from the front portions 98. The front portion 172 extends at an angle relative to the rear portion 174. The planar rear portions 168, 174 provide a stable surface upon which the bender head 22 rests as shown in FIG. 1.

While two channels 60, 62 and hooks 132, 134 are shown, a single channel and hook may be provided, or more than two channels and hooks may be provided.

Many modifications and other embodiments of the disclosure set forth herein will come to mind to one skilled in the art to which these disclosed embodiments pertain having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the disclosure. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure. In this regard, for example, different combinations of elements and/or functions than those explicitly described above are also contemplated within the scope of the disclosure. Although specific terms are employed herein, they are used in a generic and descriptive sense only and not for purposes of limitation.

While particular embodiments are illustrated in and described with respect to the drawings, it is envisioned that those skilled in the art may devise various modifications without departing from the spirit and scope of the appended claims. It will therefore be appreciated that the scope of the disclosure and the appended claims is not limited to the specific embodiments illustrated in and discussed with respect to the drawings and that modifications and other embodiments are intended to be included within the scope of the disclosure and appended drawings. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure and the appended claims.

What is claimed is:

1. A hand-held conduit bending tool for receiving first and second conduits, the first and second conduits having different diameters, the hand-held conduit bending tool comprising:

a bender head comprising a body portion having a front end, an opposite rear end, a lower surface extending from the front end to the rear end, an opposite upper surface extending from the front end to the rear end, opposite first and second side surfaces extending from the front end to the rear end, a first body channel extending upward from the lower surface and extending from the front end to the rear end, the first body channel defining a longitudinal axis, a second body channel extending upward from the lower surface and extending from the front end to the rear end, the second body channel defining a longitudinal axis, the longitudinal axes being parallel to each other, the first body channel is configured to receive the first conduit and the second body channel is configured to receive the second conduit, a central spine extending longitudinally from the body portion, the central spine having opposite first and second sides, a first hook extending from the first side of the central spine, the first hook having a front end, an opposite rear end, an upper surface extending from the front end to the rear end of the first hook, an opposite bottom surface extending from the front end to the rear end of the first hook, and a first hook channel extending downward from the upper surface of the first hook and extending from the front end to the rear end of the first hook, the first hook channel configured to receive the first conduit, a second hook extending from the second side of the central spine, the second hook having a front end, an opposite rear end, an upper surface extending from the front end to the rear end of the second hook, an opposite bottom surface extending from the front end to the rear end of the second hook, and a second hook channel extending downward from the upper surface of the second hook and extending from the front end to the rear end of the second hook, the second hook channel configured to receive the second conduit, the bender head having a length defined in a plane between the rear end of the body portion and the front ends of the first and second hook hooks, and a handle mount provided by the body portion proximate to the front end thereof and rearward of the central spine, the handle mount having a central axis which longitudinally aligns with the central spine and which is located along the length of the bender head at a distance of 60% to 65% of the length away from the rear end of the body portion, wherein the upper surface rearward of the handle mount forms an enlarged foot pedal which is configured to receive a foot of a user; and an elongated handle having a free end and a connected end, wherein a central axis of the elongated handle is defined between the ends thereof and aligns with the central axis of the handle mount, the connected end of the elongated handle being in the handle mount.

2. The hand-held conduit bending tool of claim 1, wherein the handle mount is an open ended receptacle into which the elongated handle can be inserted.

3. The hand-held conduit bending tool of claim 1, wherein the lower surface of the body portion is radiused, the bottom surface of the first hook has a front portion extending from the front end thereof and a planar rear portion extending from the front portion to the rear end thereof, the planar rear portion being angled relative to the front portion and extending tangentially from the radiused body portion, and the bottom surface of the second hook has a front portion extending from the front end thereof and a planar rear portion extending from the front portion to the rear end thereof, the planar rear portion of the second hook being angled relative to the front portion of the second hook and extending tangentially from the radiused body portion, and wherein a part of the lower surface of the body portion and the planar rear portions of the first and second hooks are in contact with a surface when the bending tool is in a stand alone head-down and handle-up resting position.

4. The hand-held conduit bending tool of claim 1, further comprising first markings provided on the lower surface of the body proximate to the first body channel, second markings provided on the first side surface of the body proximate to the first body channel, third markings provided on the second side surface of the body proximate to the second body channel, and fourth markings provided on the lower surface of the body proximate to the second body channel, wherein the first and second markings indicate bend angles for the first body channel, and the third and fourth markings indicate bend angles for the second body channel.

5. The hand-held conduit bending tool of claim 1, wherein the central axis of the elongated handle is vertical when a 30 degree bend angle has been achieved.

6. The hand-held conduit bending tool of claim 3, wherein the central axis of the elongated handle is angled relative to vertical and the elongated handle is tilted towards the front ends of the first and second hooks and away from the enlarged foot pedal when a part of the lower surface of the body portion and the planar rear portions of the first and second hooks are in contact with the surface when the bending tool is in the stand alone head-down and handle-up resting position.

7. The hand-held conduit bending tool of claim 3, wherein the first body channel includes opposite first and second side walls which are separated by a base wall, the first side wall terminating in a first lower wall surface, the second side wall terminating in a second lower wall surface, and the first body channel is elliptical in cross-section along all cross-sections thereof taken transverse to the longitudinal axis, and a first distance is defined from a midpoint of the base wall to the first lower wall surface, and a second distance is defined from the midpoint of the base wall to the second lower wall surface, each of the first and second distances are less than the diameter of the first conduit such that the first conduit extends partially out of the first body channel when positioned therein, and the second body channel includes opposite first and second side walls which are separated by a base wall, the first side wall of the second body channel terminating in a first lower wall surface, the second side wall of the second body channel terminating in a second lower wall surface, and the second body channel is elliptical in cross-section along all cross-sections thereof taken transverse to the longitudinal axis of the second body channel, and a first distance is defined from a midpoint of the base wall to the first lower wall surface of the second body channel, and a second distance is defined from the midpoint of the base wall to the second lower wall surface of the second body channel, each of the first and second distances of the second body channel are less than the diameter of the second conduit such that the second conduit extends partially out of the second body channel when positioned therein.

8. The hand-held conduit bending tool of claim 1, wherein wherein a part of the lower surface of the body portion and parts of the first and second hooks are in contact with a surface when the bending tool is in a stand alone head-down and handle-up resting position, and wherein the central axis of the elongated handle is angled relative to vertical and the elongated handle is tilted towards the front ends of the first and second hooks and away from the enlarged foot pedal when the bending tool is in the stand alone head-down and handle-up resting position.

9. A hand-held conduit bending tool for receiving first and second conduits, the first and second conduits having different diameters, the hand-held conduit bending tool comprising:

a bender head comprising a body portion having a front end, an opposite rear end, a lower surface extending from the front end to the rear end, an opposite upper surface extending from the front end to the rear end, opposite first and second side surfaces extending from the front end to the rear end, a first body channel extending upward from the lower surface and extending from the front end to the rear end, and a second body channel extending upward from the lower surface and extending from the front end to the rear end, the lower surface of the body portion being radiused, each of the first and second body channels defining a longitudinal axis, the longitudinal axes being parallel to each other, the first body channel being configured to receive the first conduit and the second body channel being configured to receive the second conduit, a central spine extending longitudinally from the body portion, the central spine having first and second opposite sides, a first hook extending from the first side of the central spine, the first hook having a front end, an opposite rear end, an upper surface extending from the front end to the rear end of the first hook, an opposite bottom surface extending from the front end to the rear end of the first hook, and a first hook channel extending downward from the upper surface of the first hook and extending from the front end to the rear end of the first hook, the first hook channel configured to receive the first conduit, a second hook extending from the second side of the central spine, the second hook having a front end, an opposite rear end, an upper surface extending from the front end to the rear end of the second hook, an opposite bottom surface extending from the front end to the rear end of the second hook, and a second hook channel extending downward from the upper surface of the second hook and extending from the front end to the rear end of the second hook, the second hook channel configured to receive the second conduit, and a handle mount provided by the body portion proximate to the front end thereof and rearward of the central spine, wherein the upper surface of the body portion rearward of the handle mount forms a foot pedal which is configured to receive a foot of a user; and an elongated handle having a free end and a connected end, wherein a central axis of the elongated handle is defined between the ends thereof, the connected end of the elongated handle being in the handle mount, wherein a part of the lower surface of the body portion and parts of the bottom surfaces of the first and second hooks are in contact with a surface when the bending tool is in a stand alone head-down and handle-up resting position, and wherein the central axis of the elongated handle is angled relative to vertical and the elongated handle is tilted towards the front ends of the first and second hooks and away from the foot pedal when the bending tool is in the stand alone head-down and handle-up resting position.

10. The hand-held conduit bending tool of claim 9, wherein the handle mount is an open ended receptacle into which the elongated handle can be inserted.

11. The hand-held conduit bending tool of claim 9, further comprising first markings provided on the lower surface of the body portion proximate to the first body channel, second markings provided on the first side surface of the body portion proximate to the first body channel, third markings provided on the second side surface of the body portion proximate to the second body channel, and fourth markings provided on the lower surface of the body portion proximate to the second body channel, wherein the first and second markings indicate bend angles for the first body channel, and the third and fourth markings indicate bend angles for the second body channel.

12. The hand-held conduit bending tool of claim 9, wherein the central axis is vertical when a 30 degree bend angle has been achieved.

13. The hand-held conduit bending tool of claim 9, wherein the first body channel includes opposite first and second side walls which are separated by a base wall, the first side wall terminating in a first lower wall surface, the second side wall terminating in a second lower wall surface, and the first body channel is elliptical in cross-section along all cross-sections thereof taken transverse to the longitudinal axis, and a first distance is defined from a midpoint of the base wall to the first lower wall surface, and a second distance is defined from the midpoint of the base wall to the second lower wall surface, each of the first and second distances are less than the diameter of the first conduit such that the first conduit extends partially out of the first body channel when positioned therein, and the second body channel includes opposite first and second side walls which are separated by a base wall, the first side wall of the second body channel terminating in a first lower wall surface, the second side wall of the second body channel terminating in a second lower wall surface, and the second body channel is elliptical in cross-section along all cross-sections thereof taken transverse to the longitudinal axis of the second body channel, and a first distance is defined from a midpoint of the base wall to the first lower wall surface of the second body channel, and a second distance is defined from the midpoint of the base wall to the second lower wall surface of the second body channel, each of the first and second distances of the second body channel are less than the diameter of the second conduit such that the second conduit extends partially out of the second body channel when positioned therein.

14. The hand-held conduit bending tool of claim 9, wherein the bottom surface of the first hook has a front portion extending from the front end thereof and a planar rear portion extending from the front portion to the rear end thereof, the planar rear portion being angled relative to the front portion and extending tangentially from the radiused body portion, and the bottom surface of the second hook has a front portion extending from the front end thereof and a planar rear portion extending from the front portion to the rear end thereof, the planar rear portion of the second hook being angled relative to the front portion of the second hook and extending tangentially from the radiused body portion, and wherein the planar rear portions are in contact with the surface when the bending tool is in the stand alone head-down and handle-up resting position.

* * * * *